United States Patent [19]

Stewart

[11] Patent Number: 4,701,585

[45] Date of Patent: Oct. 20, 1987

[54] MICROWAVE BROWNING COOKWARE

[75] Inventor: James B. Stewart, Randolph, N.J.

[73] Assignee: Kidde Consumer Durables Corp., Bala Cynwyd, Pa.

[21] Appl. No.: 848,176

[22] Filed: Apr. 4, 1986

[51] Int. Cl.[4] ..... H05B 6/80

[52] U.S. Cl. ..... 219/10.55 E; 219/10.55 F; 99/DIG. 14; 126/390

[58] Field of Search ..... 219/10.55 E, 10.55 F, 219/10.55 M, 10.55 R, 10.49 R; 99/DIG. 14, 451; 126/390; 426/243, 241

[56] References Cited

U.S. PATENT DOCUMENTS

| | | | |
|---|---|---|---|
| 2,830,162 | 4/1958 | Copson et al. | 219/10.41 |
| 3,539,751 | 11/1970 | Levinson | 219/10.55 |
| 3,662,141 | 5/1972 | Schauer, Jr. | 219/10.55 |
| 3,701,872 | 10/1972 | Levinson | 219/10.55 E |
| 3,777,099 | 12/1973 | Levinson | 219/10.55 |
| 3,966,426 | 6/1976 | McCoy et al. | 219/10.49 R X |
| 4,190,757 | 2/1980 | Turpin et al. | 219/10.55 E |
| 4,454,403 | 6/1984 | Teich et al. | 219/10.55 E |
| 4,486,640 | 12/1984 | Bowen et al. | 219/10.55 E |
| 4,496,815 | 1/1985 | Jorgensen | 219/10.55 E |
| 4,542,271 | 9/1985 | Tanonis et al. | 219/10.55 E |

*Primary Examiner*—Philip H. Leung

*Attorney, Agent, or Firm*—Seidel, Gonda, Goldhammer & Abbott

[57] ABSTRACT

A microwave cookware comprising a body and a browning portion having a cooking surface and a separate heat absorbing body. The heat absorbing body is in contact with a heating matrix which absorbs microwave energy such that increased amount of heat is retained for transfer to the cooking surface.

13 Claims, 4 Drawing Figures

FIG. 1
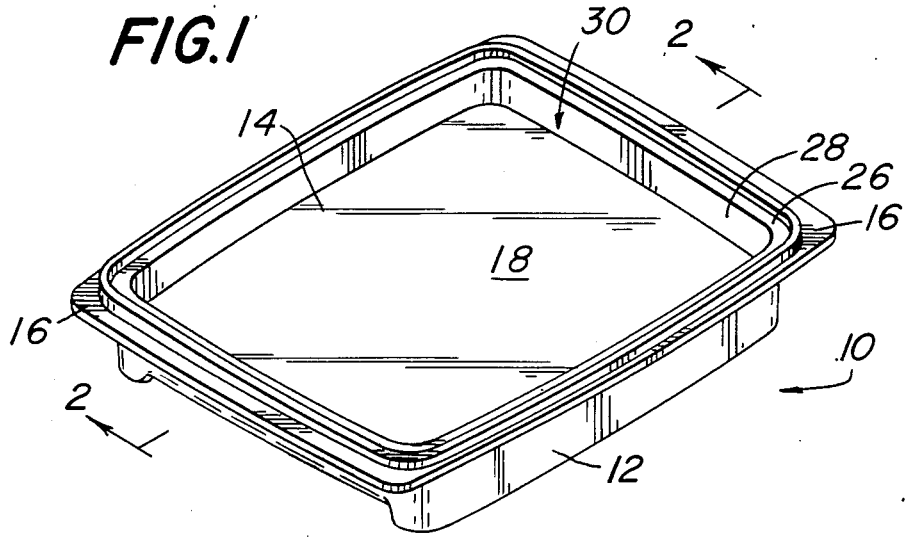
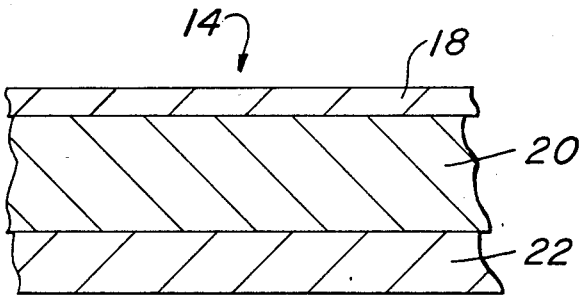
FIG. 4

MICROWAVE BROWNING COOKWARE

This application is related to commonly assigned, co-pending design application Ser. No. 847,897 filed 4/04/86.

BACKGROUND OF THE INVENTION

This invention relates to cookware for use in microwave ovens. In particular, the invention relates to cookware which causes browning of the exterior surfaces of the food prepared through use of microwave energy such that the food has the same or similar appearance as food prepared by conventional ovens or grills.

The browning cookware contemplated by this invention is an improvement over that described in U.S. patents to Levinson, U.S. Pat. Nos. 3,701,872 and 3,777,099, and to Tanonis, et al, U.S. Pat. No. 4,542,271.

The Levinson patents teach cookware articles for and methods of heating food in a microwave type oven. The Levinson cookware includes a body portion made of a microwave non-absorptive material, a bed of resistive particles which utilize microwave radiation to create heat, and a plurality of metal rods or other heat conducting portions embedded within the resistive particles to conduct the heat generated by the resistive particles when exposed to microwave radiation. The described combination is formed as a cookware pan and as a bottom shelf in a microwave oven chamber. The food is placed on the cookware or shelf and exposed to microwave radiation. The microwave absorptive material, which is described as a ferrite material, causes what is described as an arcing and sparking on exposure to the microwaves and generates heat. The plurality of rods are placed in a pattern within the body member and the bed of particles so as to provide a heating pattern for the food placed on the cookware. The heat generated by the microwave absorptive particles is conducted by the plurality of rods which are placed in proximity to the food. The heat in the rods causes browning of the food surfaces adjacent to the cookware or shelf.

The Tanonis et al patent describes a microwave absorptive material which is maintained within a polymer matrix. The matrix is cured onto the lower surface of the metallic pan which forms the cooking or browning surface. The matrix includes a combination of plastic type materials in which is embedded magnetite particles which absorb microwave energy. The magnetite creates heat by absorbing microwave energy and elevating in temperature to its Curie temperature. When the magnetite reaches this Curie temperature, the material stops absorbing microwave energy and remains at that temperature level. Magnetite does not heat by arcing and sparking as described in the Levinson patents. The magnetite material within the polymer matrix may be applied directly to the underside of the metallic pan of the cookware. The metallic pan is made from a thin sheet of aluminum or other high heat conducting material and is coated with a TEFLON (registered trademark for Tetra Fluoroethylene Fluorocarbon Polymer) or the like which acts as a non-stick cooking surface. The polymer and magnetite matrix is layered on the bottom of the metallic pan and is retained within the body of the microwave cookware.

The problem arising in known versions of microwave browning cookware is particularly exemplified by the method of cooking food outside of the microwave oven chamber. Typically, this type microwave cookware may be placed within the oven chamber and heated by exposure of the absorptive material to microwave radiation. The cookware is then removed from the oven chamber with the metal rods or pan retaining the heat generated by the absorptive material (ferrite or magnetite). The cookware is then utilized as a grilling surface to cook food by contact with the heated surfaces. The cookware may also be utilized in conjunction with the microwave energy by returning the heated cookware and the food into the oven chamber. In a typical situation the food, such as a sandwich, would be grilled on the heated surface of the cookware similar to heating on the surface of a griddle or frying pan. However, the amount of heat retained by the metal portions of the known cookware is insufficient to grill both sides of the food and to provide a browned or toasted surface on both sides. Typically, if the food and cookware is returned to the microwave oven, the microwave energy may cause some portions of the food (such as cheese in a sandwich) to be cooked faster than the surfaces being toasted or browned. Therefore, in known microwave cookware the amount of heat available to cook or grill the food is limited.

Another typical problem of known microwave cookware of this type relates to the deterioration of the coating on the cooking surface and also the metal materials when exposed to microwave radiation. Microwave browning wares, when utilized with any separate pan or dish, which is made of a metal material may cause a capacitance effect between the cooking surface and the separate pan. Such separate pans include those sold with frozen pies and the like which require cooking prior to consumption. If this article of food, which is sold in its own disposable cooking pan, were to be prepared in a microwave oven, the exterior food surfaces may not be properly browned since the microwave radiation would be reflected by the metal pan and the microwaves typically do not cause browning without a browning type ware. If the pan were placed on the browning ware, the space separating the cooking surface and the metalic pan would create the capacitance effect and would cause arcing through the coating. The arcs caused by the microwave energy also generally cause deterioration of the coating and the cooking pan. Additionally, use of cooking implements, such as spatulas, knifes or forks on the coated cookware, will cause the coating to be scratched or partially removed while cooking.

SUMMARY OF THE INVENTION

The microwave browning cookware contemplated by this invention includes a body portion of a microwave nonabsorptive material. This material should be sufficient to withstand the operating temperatures of the microwave oven environment, such as the typical temperatures of the food being cooked. Provided along with the microwave nonabsorptive body is a metallic cooking surface. This cooking surface is preferably of a stainless steel type material or other material which does not require a coating for use in cooking operations. A separate heat absorbing body is attached to the lower surface of the cooking suface. The heat absorbing body is typically an aluminum or other high heat conducting material. A heating matrix which absorbs microwave radiation to produce heat is positioned in contact with the heat absorbing material. The invention may include the magnetite and polymer combination type heating matrix described in the Tanonis et al patent referred to above.

A combination of a separate cooking surface and heat absorbing body (having a higher heat absorbing capacity than known single material browning cookware) provides a safer and more useful cookware. The material of the heat absorbing body is preferrably provided in greater thickness than previously possible in known cookware for greater heat retention. Additionally, the present invention overcomes the problem of the joint, between the cooking surface material and the body of the microwave nonabsorbing material, in known cookware exceeding the permissable operating conditions of the body material if the cooking surface absorbs excessive heat from the matrix. The greater heat retention of the present invention is achieved without exposing the cookware body material to excessive temperatures. A separate cooking surface provides support for the heat absorbing material and separates this material from the attachment position of the the microwave nonabsorbing body and the cooking surface. The stainless steel cooking surface has a lower heat transfer coefficient than an aluminum material. Additionally, the heat generating material and heat absorbing body contemplated for use in this invention is separated with sufficient distance to limit the exposure of the cookware body and cooking surface joint to excessive tempertures while increasing the amount of heat that may be absorbed and retained from the microwave absorptive material.

The TEFLON or other coating material applied to prevent contact between the aluminum and the food being cooked is provided as a nonstick cooking surface. As expressed earlier the coating material may be subject to degradation when exposed to microwave radiation and may also be removed from the pan during normal use. By providing a stainless steel cooking surface the need for a coating is eliminated. The stainless steel cooking surface is more durable when subject to microwave irradiation and meets health standards without requiring a TEFLON type coating.

Further advantages of the invention will become apparent by particularly describing a preferred embodiment. For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 1 shows a perspective view of a microwave browning cookware as contemplated by this invention.

FIG. 4 shows an exploded cross-sectional view as taken in FIG. 2.

DETAILED DESCRIPTION OF THE INVENTION

Figure 2:
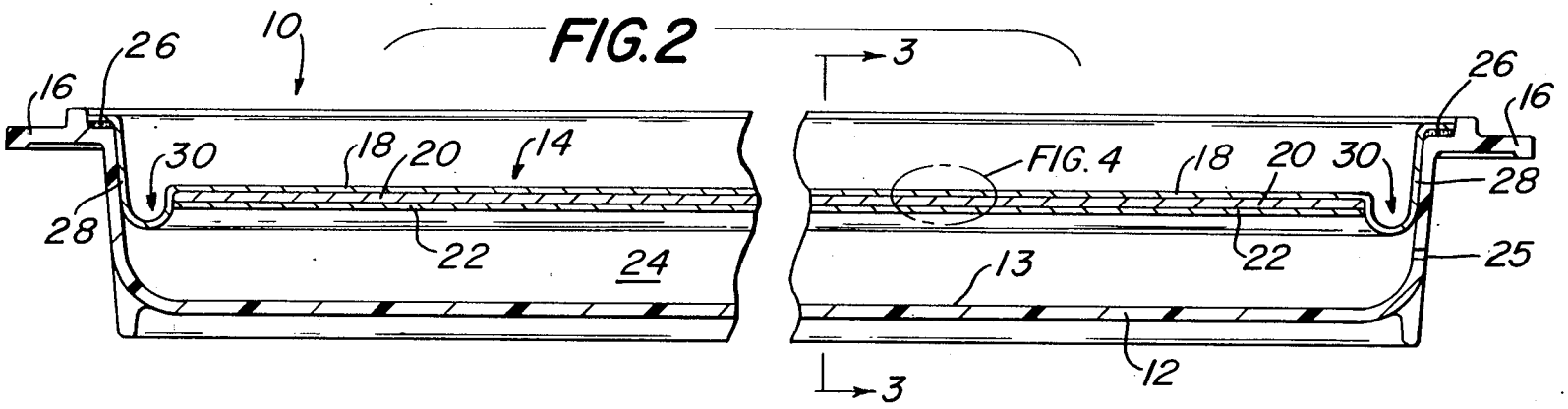
FIG. 2 shows a cross-sectional view of the invention taken along line 2—2 in FIG. 1.

In the Figures, where like numerals indicate like elements, is shown an embodiment of a microwave browning cookware as contemplated by this invention. The cookware is generally referred to by the numeral 10 and substantially comprises a body or dish 12 which is preferably made of a microwave non-absorptive material. The body 12 may be made of any material which can withstand the operating temperatures and conditions of the cooking operation within a microwave environment. Such materials are typically thermostat polyesters which can withstand operating temperatures in the neighborhood of 425° F. A typical cooking and storage container as contemplated for use with this invention is described in commonly assigned, co-pending application Ser. No. 848,177, filed on 4/04/86, entitled "Cooking and Storage Containers" and shown in design application No. 847,897, filed on 4/04/86, entitled "Cooking and Storage Container". Mounted within the cavity or food containment area formed by the body 12 is browning portion 14 which is supported from an annular rim 16 on the body portion 12. The browning portion 14 generally includes a cooking surface 18, a heat absorbing body 20 and a microwave absorbing heating matrix 22. The browning portion 14 of the cookware 10 is supported within the interior of the body 12 such that a space or insulating area 24 is provided between the heating matrix 22 and the bottom 13 of the body 12.

The cooking surface 18 of the cookware 10 is perferably a stainless steel material which is provided in a thin sheet with sufficient thickness to maintain its rigidity when subject to the weight of a food material on its surface. The cooking surface 18 must also be of sufficient thickness so that when exposed to microwave irradiation the integrity of the material is maintained. Typically, a thickness of 0.02 inches of a 300 series type stainless steel will be sufficient for the purpose of the invention. The cooking surface 18 shown in FIG. 1 has a generally rectangular shape corresponding substantially to the form of the body 12. It should be noted that the cooking surface 18 and body 12 may be provided in any desired shape and configuration and is not limited to the generally rectangular configuration or to the flat grill-like surface as shown in the drawings. Additionally the cooking surface 18 may be provided with a plurality of ribs or projections (not shown) which form a grill type surface. Thus, the microwave cookware 10 utilized in this invention may be utilized to sear meat and the like or may be utilized to prepare foodstuffs such as waffles.

The cooking surface 18 is supported on the rim 16 of the body portion 12 by means of an support arm 26 which rests on or is attached to the rim 16 of the body. Support arm 26 as shown is substantially horizontal and parallel to the cooking surface 18. Support arm 26 generally wraps over the interior edge of the rim 16 and forms a wall portion 28 which extends downwardly into the area or cavity defined by the body 12. The wall portion 28 may be provided in contact with the interior surface of the cavity formed by the body 12 or may be separated therefrom depending on the heat transfer characterists of the material of the wall 28 and the maximum usage temperatures of the material of the body 12. The bottom portion of the cooking surface 18 generally extends to a position adjacent to but spaced from the interior cavity wall of the body 12. The edge of the cooking surface 18 and the wall portion 28 are joined by an annular channel or groove 30. Channel 30 is provided to permit run off of fat and/or other fluids which may be expelled by the food being cooked or browned on surface 18. Channel 30 should also have a sufficient radius of curvature (R) to separate its opposing portions, such that arcing will not occur between these portions when exposed to microwave radiation. Typically this radius of curvature may be in the area of 0.125 inches.

Attached to the cooking surface 18 of the browning portion 14 is a separate heat absorbing body 20. Body 20 is bonded directly to the underside of the cooking surface 18 and extending substantially to a position adjacent to channel 30. Preferably, the combination of the cooking surface 18 and heat absorbing body 20 is formed from a composite material of a stainless steel and aluminum respectively. These materials may be permanently bonded together similar to that produced by Pfizer, Inc. under the Tradename DURANEL II. However, any type joint between the cooking surface 18 and the heat absorbing body 20 may be utilized as long as the bond is sufficient to prevent arcing between the portions when exposed to microwave radiation. The heat absorber body 20, preferably, has a thickness which is greater than that of the cooking surface 18. Typically, the stainless steel cooking surface 18 will be provided at a thickness of 0.02 inches with the aluminum material having a thickness in the range of 0.08 to 0.11 inches. A large, heat absorbing body 20 provides an increased heat absorbing capacity over known browning type wares. The heat absorbed by the body 20 is transferred through the cooking surface 18 so that the desired cooking and browning may be achieved over a longer period of time than found in these known wares. Additionally, a separate heat absorber body 20 and the cooking surface 18 does increase the exposure of the cookware body portion 20 to significantly increase operating temperatures.

In the Tanonis patent referred to above the cooking surface is designed to act as both the support surface for the food and as the heat absorber. This type structure is indicated to be made of an aluminum material but may also be some other high heat absorbing material. However, these materials include a high rate of heat conduction. The pan in Tanonis substantially forms the cooking surface and is supported by the body portion of the cookware directly adjacent to its heating matrix. The body 12 in this type combination may be exposed to high operating temperatures. Additionally, by limiting the thickness of the cooking surface in the known wares, so as to operate at acceptable use temperatures for the body portion, the amount of heat retained by the pan is greatly restricted. Therefore, sufficient heat will not be retained to cook foods which require extended periods of browning time.

By providing a stainless steel cooking surface 18 as opposed to an aluminum surface the contact surfaces of the cookware are maintained in better sanitary conditions. Typically, aluminum or copper materials must be coated with a TEFLON type material so that the food is not directly exposed to the surface of this metal. Additionally, metals which are of insufficient thickness when exposed to microwave radiation may degrade to a point where their support function deteriorates or may be deposited on the food being browned. The coating materials such as the TEFLON may also be degradated due to exposure to microwave radiation. The stainless steel material contemplated for use in the present invention provides a sanitary cooking surface and has a sufficient thickness so that it will not deteriorate due to microwave exposure or normal use. Such deterioration may cause a health hazard or may cause the structure of the invention to essentially self-destruct.

The browning cookware 10 of the present invention may also be utilized with frozen and pre-prepared food which are sold in a metallic type disposable pan. The disposable pan may be placed directly on top of the browning surface 14 without causing a destructive effect on the cookware 10 while providing the desired browning effect on the food. When exposure to microwave radiation, the heat generated by the matrix 2 is transferred to the absorbing body 20 and through the cooking surface 18 to heat the pan and the food. The pan and the cooking surface 18 of the present invention are positioned in direct contact. Although a capacitance effect may be created through any air space between the pan and the cooking surface 18, a significant destructive effect to the cooking surface 18 is not created. The steel type cooking surface has a lower electromotive potential than the pan which is typically made of an aluminum material. Any arcing created by the capacitance effect of the air space would be in the direction of the pan and not towards the cooking surface 18. Additionally, the pan would not be exposed to arcing for extended or repetative time periods and, therefore, would not be exposed to any significant deterioration during use. The pan is designed to be disposable unlike the microwave cookware 10 which is designed for reuse. Known cookwares, however, would be subject to the destructive effect of the capacitance arcing in the presence of the microwave radiation if food were to be cooked in this manner.

Attached to the heat absorbing material is a heating matrix 22 which is made from a microwave absorbing material. Microwave absorbing materials are those which, when subject to microwave radiation, create heat. These microwave absorbing materials typically heat to their Curie temperature and then cease to absorb microwave radiation and do not heat above the Curie temperature. The preferred material utilized in the present invention is similar to that described in the Tanonis et al patent. The teachings of the Tanonis et al patent are herein incorporated by reference for the purpose of disclosure. This magnetite type material which is combined in a polymer matrix can be attached directly to the lower surface of the heat absorbing body 20 in a thin layer. However, this invention is not limited to this type heating matrix 22, other heating materials which are microwave absorptive are also contemplated for use in this invention.

Figure 3:
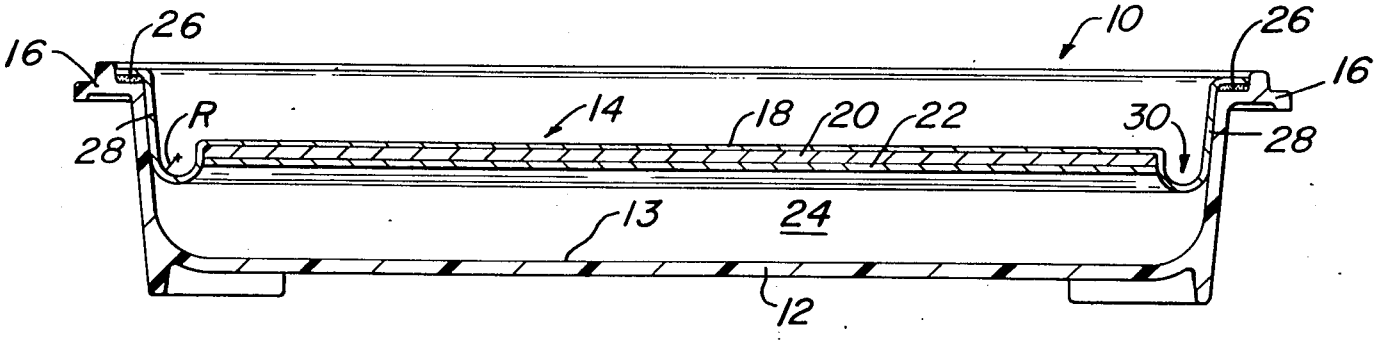
FIG. 3 shows a cross-sectional view of the invention taken along line 3—3 in FIG. 2.

As seen in FIGS. 2 and 3, the browning portion 14 of the cookware 10, when assembled, is spaced from the bottom surface 13 of the body 12 by a sufficient distance so that the radiated or convected heat from the heat absorbing body 20 and the heating matrix 22 does not expose the interior of the body 12 to temperatures which are above its maximum use limitations. Typically, this space 24 is filled with air which acts as an insulator for the heat generated by the heating matrix 22. The body portion 12 is perferably provided with a pin hole or opening 26 in one of the side walls to permit expansion of the air within the space 24 as it is heated. Other insulating materials may be provided in space 24 although if properly designed, air within this space 24 will be sufficient as an insulator to protect the body 12 and to project the heat created by the heating matrix 22 towards the heat absorbing body 20 and, therefore, through the cooking surface 18.

By providing the combination of a thin, rigid cooking surface 18 with a separate, realtively larger heat absorbing body 20 in contact with the cooking surface 18, the heat produced by the heating matrix 22 is retained in sufficient amounts so that an increase cooking and browing capacity results.

Typically, the cookware 10 may be placed into the microwave oven for a brief period of time to elevate the temperature of the heating matrix 22. The cookware 10 is then removed for cooking. The body portion 12 acts as an insulator so that the cookware 10 may be handled easily by the user without exposure to excessive temperatures which may cause burning. The cooking surface 18 portion may then be used as a griddle or grill as desired or the food may be placed on the cooking surface for browning and returned to the microwave oven chamber, so that the food is subject to both the conducted heat from the browning portion 14 as well as the microwave irradiation of the microwave oven. In either situation the food is subject to a browning effect which causes cooking or toasting of the contacting surface.

The materials described herein should not limit the scope of the disclosure. The structure and function of the described invention should be considered as describing the content of the present invention. The present invention may be embodied inother specific forms without departing from the spirit or essetial attributes thereof and, accordingly, reference should be made to the appended claims, rather than to the foregoing specification, as indicating the scope of the invention.

I claim:

1. A cookware for use in a microwave over comprising: a body of a microwave non-absorbing material and a browning portion, said browing portion having a continuous metallic cooking surface which supports the browing portion on the body, a heat absorbing portion in contact with the bottom of the cooking surface and said heat absorbing portion being made from a material having a thermal conductivity greater than said cooking surface and provided in a relatively larger mass than said cooking surface, and a heating matrix of a microwave absorptive material in contact with the heat absorbing portion, the heating matrix adapted upon exposure to microwave radiation to create heat which is absorbed by the heat absorbing portion and retained, the heat retained by the heat absorbing portion being transferred to the cooking surface to cause a browning effect on food to be cooked.

2. A cookware as claimed in claim 1 wherein said cooking surface is made of a stainless steel material.

3. A cookware as claimed in claim 1 wherein said heat absorbing poriton is made of an aluminum material.

4. A cookware as claimed in claim 1 wherein said cooking surface is made of a stainless steel material and said heat absorbing portion is made of an aluminum material.

5. A cookware as claimed in claim 4 wherein said stainless steel cooking surface has a thickness of approximately 0.02 inches.

6. A cookware as claimed in claim 5 wherein said aluminum heat absorbing portion has a thickness between 0.08 and 0.11 inches, inclusive.

7. A cookware as claimed in claim 1 wherein said body is made of a thermostat polyester material.

8. A cookware as claimed in claim 1 wherein said browning portion is positioned within the body portion exposing only the cooking surface of the browning portion.

9. A cookware as claimed in claim 1 wherein said browning portion further comprises a channel surrounding the cooking surface and intergrally formed with said cooking surface.

10. A cookware as claimed in claim 1 wherein said browning portion further comprises a support contacting the body portion and positioning the browning portion within the body portion exposing only the cooking surface of the browning portion.

11. A cookware for use in microwave ovens comprising: a body defining an interior cavity open at its upper end and a rim around the cavity; a browning portion supported on the rim of the body, said browning portion including an integrally formed first portion of a relatively thin but rigid sheet of a stainless steel material and having a cooking surface, support arm, extension arm, and annular channel, the browning portion also including a heat absorbing body and a microwave absorptive matrix, the support arm of the first portion resting on the rim of the body, the extension arm extending into the cavity in the body from the support arm, the annular channel connecting the cooking surface to the extension arm, the channel formed adjacent to the cavity wall of the body, the cooking surface forming the bottom surface of the cookware within the body cavity, the heat absorbing body attached to the lower surface of the cooking surface between the annular channel and the heating matrix, the heat absorbing body made from a material having a thermal conductivity greater than stainless steel and provided in a relatively larger mass than the first portion, the heating matrix formed on the absorbing body opposite of its attachment to the first portion.

12. A cookware for browning the exterior surfaces of food prepared in a microwave oven comprising: a first portion having continuous metallic cooking or browning surface, a heat absorbing portion attached to the unexposed surface of the first portion, said heat absorbing portion having a higher thermal conductivity than the first portion and a thickness several times that of said cooking surface, and a heating portion in contact with the heat absorbing portion opposite its attachment to the first portion, the heating portion adapted to absorb microwave energy to create heat.

13. A cookware for use in microwave ovens comprising: a body formed from a microwave non-absorbing material, said body having a bottom wall, a side wall and a rim positioned around the upper periphery of the side wall; a continuous metallic pan having an upper cooking surface, a lower surface and a side wall, the pan adapted to be supported by the rim of the body with the side wall of the pan extending into the body towards the bottom wall, the side wall of the pan being spaced from the side wall of the body and the pan forming a cavity between its lower surface and the body bottom wall; a heat absorbing body fused to the lower surface of the metallic pan and maintained in the cavity between the lower surface and the body bottom wall, the heat absorbing body having a greater mass and a higher thermal conductivity than said metallic pan and a thickness several times that of said metallic pan, and a heating mtrix adapted to create heat when exposed to microwave radiation, the matrix attached to the lower surface of the heat absorbing body.

* * * * *